US011224901B2

(12) United States Patent
Haeggström et al.

(10) Patent No.: US 11,224,901 B2
(45) Date of Patent: Jan. 18, 2022

(54) SYSTEM AND A METHOD FOR CLEANING OF A DEVICE

(71) Applicant: ALTUM TECHNOLOGIES OY, Helsinki (FI)

(72) Inventors: Edward Haeggström, Helsinki (FI); Timo Rauhala, Helsinki (FI); Petro Moilanen, Kinkomaa (FI); Ari Salmi, Helsinki (FI)

(73) Assignee: ALTUM TECHNOLOGIES OY, Helsinki (FI)

( * ) Notice: Subject to any disclaimer, the term of this patent is extended or adjusted under 35 U.S.C. 154(b) by 4 days.

(21) Appl. No.: 16/300,610

(22) PCT Filed: May 9, 2017

(86) PCT No.: PCT/FI2017/050361
§ 371 (c)(1),
(2) Date: Nov. 12, 2018

(87) PCT Pub. No.: WO2017/194839
PCT Pub. Date: Nov. 16, 2017

(65) Prior Publication Data

US 2019/0111457 A1 Apr. 18, 2019

(30) Foreign Application Priority Data

May 13, 2016 (FI) ..... 20165410

(51) Int. Cl.
*B08B 3/12* (2006.01)
*F28G 7/00* (2006.01)
*F28G 15/00* (2006.01)

(52) U.S. Cl.
CPC ..... *B08B 3/12* (2013.01); *F28G 7/00* (2013.01); *F28G 15/003* (2013.01)

(58) Field of Classification Search
None
See application file for complete search history.

(56) References Cited

U.S. PATENT DOCUMENTS 4,244,749 A 1/1981 Sachs et al.
4,375,991 A * 3/1983 Sachs ..... B08B 3/12 134/1
2013/0279561 A1* 10/2013 Jin ..... H04L 25/4902 375/239
2015/0151141 A1* 6/2015 Amal ..... A61N 7/00 181/177

* cited by examiner

*Primary Examiner* — Mikhail Kornakov
*Assistant Examiner* — Pradhuman Parihar
(74) *Attorney, Agent, or Firm* — Jacob Eisenberg

(57) ABSTRACT

The present invention relates to systems and methods for cleaning of devices, such as heat exchangers. According to the invention, controlled cavitation is created at predetermined positions within a device. The cavitation is done by mechanical waves, such as ultrasound waves, generated by transducers, wherein the waves are based on output of time-reversal wave form analysis of the device structures.

8 Claims, 16 Drawing Sheets

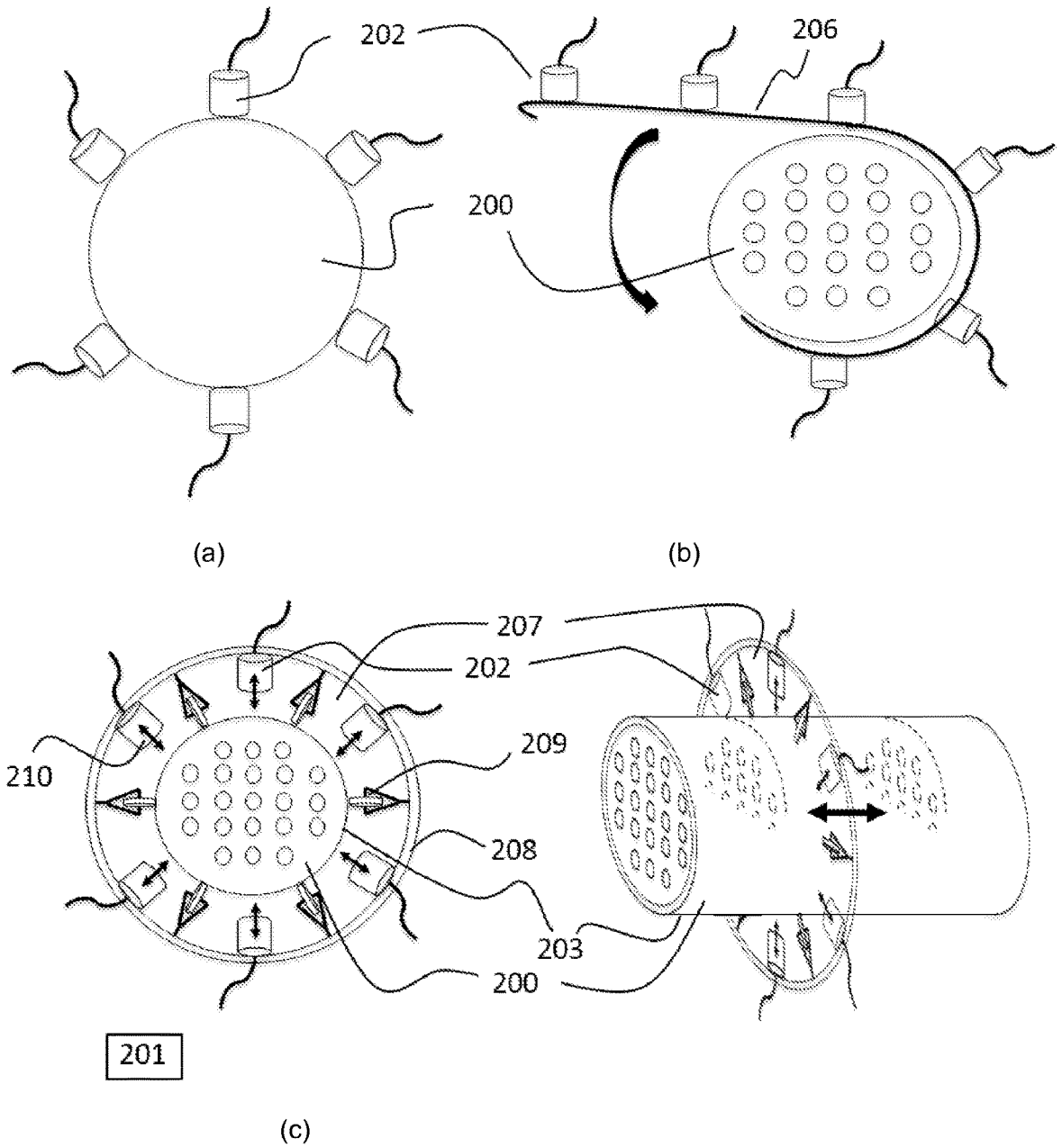
Figure 2 a-c

1700

SYSTEM AND A METHOD FOR CLEANING OF A DEVICE

FIELD

The present invention relates to systems and methods for cleaning of devices, such as heat exchangers, in particular to systems and methods including computer assisted simulations of time-reversal signals.

BACKGROUND

The cleaning of fouled heat exchanges presents a significant challenge to the maintenance and operation of e.g. chemical, petroleum and food processes. Despite efforts in the design of processes and hardware to minimize fouling, eventually the intricate interior surface of the exchanger require cleaning to restore the unit to the required efficiency.

Heat exchangers are typically cleaned onsite by removing the exchanger and by placing the unit on a wash pad for spraying with high pressure water to remove foulants. Cleaning heat exchangers in an ultrasonic bath requires specially designed vessels that allow coupling sound into them and that are capable of holding sufficient fluid to affect the cleaning, and that feature specific design to allow easy removal of the foulant material from the immersed device.

US 2012055521 discloses a segmental ultrasonic cleaning apparatus configured to remove scales and/or sludge deposited on a tube sheet. The segmental ultrasonic cleaning apparatus includes a plurality of segment groups arranged in a ring shape on a top surface of a tube sheet along an inner wall of the steam generator, in which each segment groups includes an ultrasonic element segment and a guide rail support segment loosely connected to each other by metal wires located at a lower portion of the steam generator, such that ultrasound radiated from transducer in each of the ultrasonic element segments travels along the surface of the tube sheet, with the segment groups tightly connected in the ring shape by tightening the metal wires via wire pulleys of flange units.

US 2007267176 discloses a method wherein fouling of heat exchange surfaces is mitigated by a process in which a mechanical force is applied to a fixed heat exchanger to excite a vibration in the heat exchange surface and produce shear waves in the fluid adjacent to the heat exchange surface. The mechanical force is applied by a dynamic actuator coupled to a controller to produce vibration at a controlled frequency and amplitude that minimizes adverse effects to the heat exchange structure. The dynamic actuator may be coupled to the heat exchanger in place and operated while the heat exchanger is on line.

US2008073063 discloses a method for reducing the formation of deposits on the inner walls of a tubular heat exchanger through which a petroleum-based liquid flows. The method comprises applying one of fluid pressure pulsations to the liquid flowing through the tubes of the exchanger and vibration to the heat exchanger to affect a reduction of the viscous boundary layer adjacent to the inner walls of the tubular heat exchange surfaces. Fouling and corrosion were further reduced using a coating on the inner wall surfaces of the exchanger tubes.

The state of art systems and devices for heat exchanger cleaning still face challenges, regarding proper cleaning of the internal structures of the heat exchanger. Accordingly, there is still a need for further systems and methods for ultrasound cleaning of devises.

SUMMARY

The present invention is based on the observation that at least some of problems related to cleaning of internal structures of a device for holding fluid, such as a heat exchanger, can be avoided or at least alleviated by creating controlled cavitation at predetermined positions within a device. According to the present invention the cavitation is created by mechanical waves, such as ultrasound waves, generated by transducers, wherein the waves are based on output of time-reversal analysis of the device structure.

Accordingly, it is an object of the present invention to provide a system for cleaning a device for holding fluid. The system comprises transducer controlling means and one or more, preferably at least two, first transducers, wherein the one or more first transducers are adapted to be positioned on, or in proximity of, the outer surface of the device, and to emit a succession of mechanical waves towards one or more target points within the device. The system of the present invention comprises also emitter instructions comprising simulated time-reversal wave form data from the one or more target points. According to the invention, the transducer controlling means is adapted to execute the emitter instructions to the one or more first transducers so that the mechanical waves are produced.

It is another object of the present invention to provide a method for cleaning a device holding fluid, the method comprising:

- determining one or more target points within the device,
- positioning one or more first transducers on, or in proximity of, outer surface of the device,
- producing simulated time-reversal mechanical waveform data, the producing comprising simulating time-reversal mechanical waveform from the one or more target points towards the one or more first transducers,
- producing emitter instructions comprising the simulated time-reversal mechanical waveform data,
- instructing, based on the emitter instructions, the one or more first transducers, and
- the one or more first transducers emitting, based on the instructing, a succession of so mechanical waves towards the one or more target points.

It is still an object of the present invention to provide a method for cleaning of a device holding fluid, the device comprising a first portion and a second portion, the method comprising

- determining one or more virtual sources within the first portion,
- determining one or more target points within the first portion,
- positioning two or more first transducers on, or in proximity of, outer surface of the device, wherein the outer surface is within the second portion,
- producing simulated time-reversal waveform data, the producing comprising simulating time-reversal mechanical waveform propagating from the one or more target points towards the one or more virtual sources, and simulating time-reversal mechanical waveform propagating from the one or more virtual source towards the two or more first transducers,
- producing emitter instructions comprising the simulated time-reversal mechanical waveform data,
- instructing, based on the emitter instructions, the two or more first transducers, and the two or more first transducers emitting, based on the instructing, succession of focused mechanical waves towards the one or more target points.

It is still an object of the present invention to provide a device comprising a system according to the present invention.

It is still an object of the present invention to provide a computer program product which comprises program code means stored on a computer-readable medium, which code means are arranged to perform all the steps of any of claims 9-18 when the program is run on a calculating device, such as a computer.

Further objects of the present invention are described in the accompanying dependent claims.

Exemplifying and non-limiting embodiments of the invention, both as to constructions and to methods of operation, together with additional objects and advantages thereof, are best understood from the following description of specific exemplifying embodiments when read in connection with the accompanying drawings.

The verbs "to comprise" and "to include" are used in this document as open limitations that neither exclude nor require the existence of unrecited features. The features recited in the accompanied depending claims are mutually freely combinable unless otherwise explicitly stated. Furthermore, it is to be understood that the use of "a" or "an", i.e. a singular form, throughout this document does not exclude a plurality.

BRIEF DESCRIPTION OF DRAWINGS

FIGS. 11-17 show exemplary non-limiting excitation schemes to produce mechanical wave actuation points ('virtual transducers') along the third dimension of the device (e.g. a long axis of a cylindrical device) for advanced utilization of the present invention, wherein:

FIG. 11 represent maxima of standing waves in internal tubes between the end plate and a flange, FIG. 12 represents standing waves between the end plates of a shell, FIG. 13 represents focusing by leaky guided waves, FIG. 14 represents focusing by phased array excitations, FIG. 15 represents focusing by wedge excitations, FIG. 16 represents counter propagating mechanical waves, FIG. 17 represents helicoidally propagating mechanical waves.

DESCRIPTION

Figure 1:
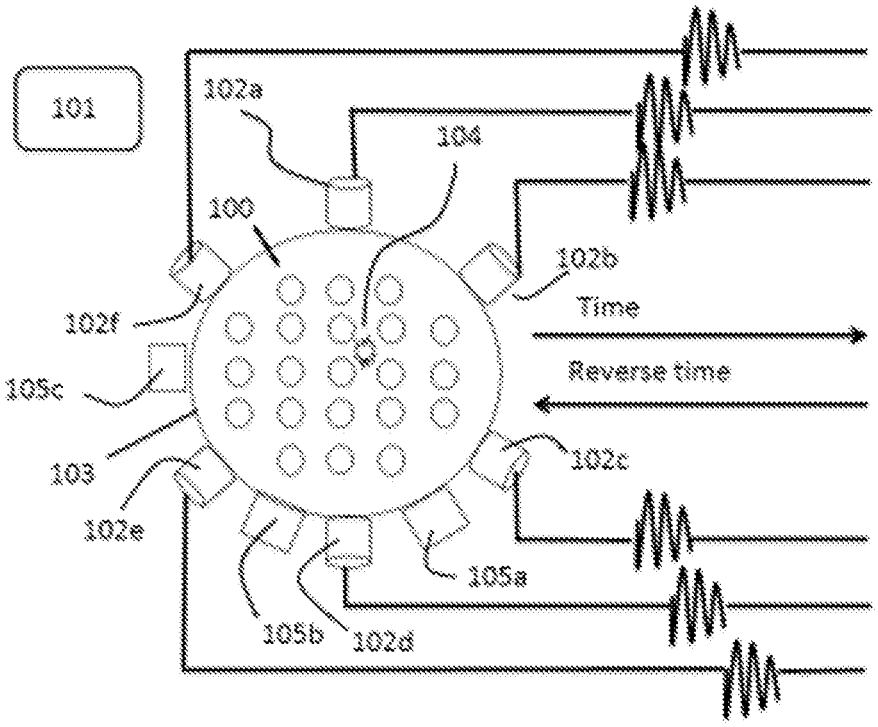
FIG. 1 shows a general principle of the method and system of the present invention. The star indicates a focal point where cavitation is created.

When the time-reversal data is determined based on actual reflections from the target only a certain type of cleaning process can be achieved. The system of and the method of the present invention allows actual online cleaning optimization and the use of various cleaning processes. The principle of the system and the method of the present invention is shown in FIG. 1.

According to one embodiment the present invention concerns a system for cleaning a device 100 that holds fluid, such as a heat exchanger. The system comprises transducer controlling means 101, and one or more, preferably at least two, first transducers 102*a-f*. The one or more first transducers are adapted to be positioned on, or in the proximity of, the outer surface 103 of the device, and to emit succession of mechanical waves towards one or more target points 104 within the device. The transducer controlling means is adapted to execute emitter instructions to the one or more first transducers for producing the determined wave form. The emitter instructions comprise data obtainable by simulating time-reversal mechanical wave form from the one or more target points. According to the invention, the system comprises emitter instructions comprising simulated time-reversal waveform data from the one or more target points.

As defined herein, mechanical waves are waves that require a medium for the transfer of their energy to occur.

Particularly suitable mechanical waves are ultrasound waves with a frequency of ca 20 kHz-2 GHz.

As defined herein, fluids are a subset of the phases of matter and include liquids, gases, plasmas and, to some extent, plastic or organic solids. A particular fluid is liquid. Exemplary liquids are water and oil.

Figure 2D:
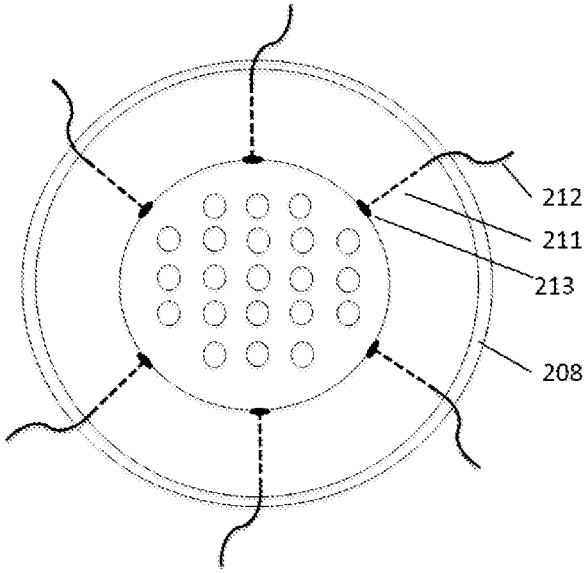
FIG. 2 shows exemplary non-limiting systems of the present invention: (a) an integral approach where the transducers are screwed or bolted or glued in a heat exchanger (b) detachable approach where the transducers are attached with a clamp-on contraption, (c) an approach wherein the transducers are attached on a positioning system and (d) an approach comprising laser ultrasonic transducers for non-galvanic and harsh environment applications.

Exemplary non-limiting transducer installations are shown in FIG. 2. In FIG. 2*a* the first transducers 202 are screwed or bolted or glued onto a heat exchanger 200. FIG. 2*b* discloses an embodiment wherein the first transducers 202 are attached with a clamp-on contraption e.g. in the aid of a belt structure 206 allowing easy installation. FIG. 2*c* discloses an embodiment wherein the transducers are attached on a positioning system 207 for moving the transducers in the proximity of the outer surface 203 of device 200. The double headed arrow in FIG. 2*c* (right) represents movement of the positioning device along the z-coordinate of the device. FIG. 2*d* discloses an embodiment wherein lasers are used for ultrasonic actuation. This is particular suitable for applications where galvanic isolation is needed or where the environment is harsh. An exemplary ultrasonic transducer shown in FIG. 2*d* is attached to the frame 208 and generates a laser beam 211 through an optical fiber 212. The laser beam, in turn is adapted to generate a laser-ultrasonic or photo-acoustic source 213 on the outer shell of the device.

According to an exemplary embodiment, the one or more first transducers are ultrasonic Langevin transducers that are adapted to be electrically and physically impedance matched to the outer surface of the device, such as to the outer surface of a heat exchanger. Particular care is on allowing transmission of sufficiently broadband transmission signals to allow efficient coded waveforms to be used. This can be done by using broadband electrical and mechanical matching techniques known in the art. For example, the impedance matching LC circuit is designed to have its resonance slightly above that of the attached transducer. This, in turn, permits sufficient bandwidth for code waveforms (e.g. 1-50% bandwidth, relative to the center frequency) and high ultrasonic power (>1 W/cm$^2$) at the same time.

According to another embodiment the one of more first transducers are adapted to be positioned in the proximity, typically 1-10 mm, from the outer surface of the device to be cleaned. The term in proximity is to be understood as a transducer that is not adapted to be in permanent physical contact with the outer surface of the device. According to this embodiment, laser ultrasonic excitation is applied, as shown in FIG. 2*d*. The laser ultrasonic excitation allows using the system without contacting the outer surface physically. Accordingly, focused towards the outer surface, the light is absorbed and creates a stress field. The stress field propagates in the target in a manner similar to the mechanical waves described above. The principle of laser ultrasonic excitation is known in the art.

The system according to the present invention comprises a transducer controlling means. An exemplary transducer controlling means is a computer system which is adapted to execute emitter instructions to the one or more first transducers. The emitter instructions of the system of the present invention comprise data obtainable by simulating time-reversal mechanical waves from one or more target points within the device. According to a particular embodiment the emitter instructions comprise data obtained e.g. by simulating time-reversal mechanical waves from one or more target points within the device. According to one embodiment, the transducer controlling means is adapted to simulate time-reversal mechanical waves from one or more predetermined target points within the device to be cleaned, preferably also to determine waveform shape of the excitation waves based on the simulation and to transfer determined waveform shape (i.e. transmit codes) to the one or more first transducers. According to another embodiment, the simulated time-reversal mechanical waveform data related to a device to be cleaned is stored in the memory of the computer system. According to this embodiment, the simulation is performed prior to the actual cleaning process. According to a preferable embodiment, the transducer controlling means comprises predetermined library of time-reversal mechanical wave data related to one or more devices to be cleaned. According to another embodiment, the simulated time-reversal mechanical wave data is inputted to the transducer controlling means prior to cleaning process.

The simulation employs structural data or data from exploratory time-reversal measurements performed on device structures, in particular using the finite element method (FEM). Exemplary geometrical models are based on one or more of technical drawing, computer assisted design, X-ray image, and mechanical wave measurement. An exemplary mechanical wave measurement is an ultrasonic image, in particular an ultrasonic pulse-echo image. The simulation may use as input the wanted pressure signal that is the position, number of cycles and peak negative pressure as functions of time inside the device to be cleaned, such as a heat exchanger. For example, the simulation accounts for specific details in the materials of the transducers, wear plates, exchanger's external structures, internal structures, fluids in external and internal structures, details in the materials and topologies/geometries. The electrical bandwidth of the entire transmit system can also be accounted for when optimizing the drive codes. The code waveforms may be generated by means of the state of the art of microcontroller, FPGA card, function generator, and sigma-delta modulator. Impedance matching is done as is known in the art.

According to a preferable embodiment, the system of the present invention comprises one or more second transducers 105*a-c* adapted to receive mechanical waves, in particular mechanical wave echoes, such as ultrasound wave echoes, emitted from the one or more target points 104, and to transfer information to the transducer controlling means 101. The use of the second transducers allows the transducer controlling means to modify e.g. the waveform shape, wave strength, wave duration, and wave focal point based on the mechanical waves received from the one or more second transducers.

Although the embodiments disclosed herein show separate first and second transducers, it is also possible to use bifunctional transducers i.e. transducers that are adapted to emit and receive ultrasonic waves.

According to another embodiment the system of the present invention comprises a positioning system 207 adapted to move the one or more first transducers 202 and/or the one or more second transducers 205 in proximity of the outer surface of the device to be cleaned. An exemplary non-limiting positioning system 207 is shown in FIG. 2*c*, wherein a front view (left) and a perspective view (right) are presented. The system positions the transducers in a desired position relative to the one or more target positions to be cleaned. This is preferable in particular when cleaning long devices such as heat exchangers. According to an exemplary embodiment, shown in FIG. 2*c* the positioning system comprises a frame 208, wherein the one or more first transducers 202, and preferably also one of more second transducers 205, are connected. The second transducers are not shown in the figure. According to this embodiment the positioning system comprises a plurality of steering wheels 209 adapted to assist smooth movement of the positioning system along the outer surface, and means 210 adapted to tune the distance of the transducers from the outer surface. According to a particular embodiment the movement of the positioning system along the outer surface is controlled by the transducer controlling means 201 which also controls the one or more first transducers 202. The movement of the positioning system 207 along the outer surface 203 of the device 200 is illustrated with the horizontal two-headed arrow in the perspective view.

According to another embodiment, the present invention concerns a method for cleaning a device comprising fluid, the method comprising:

determining one or more target points within the device, positioning one or more first transducers on, or in proximity of, the outer surface of the device, producing simulated time-reversal mechanical waveform data, the producing comprising simulating a time-reversal mechanical waveform from the one or more target points towards the one or more first transducers, producing emitter instructions comprising the simulated time-reversal mechanical waveform data, instructing, based on the emitter instructions, the one or more first transducers, and the one or more first transducers emitting, based on the instructing, succession of mechanical waves towards the one or more target points.

According to an exemplary embodiment the method comprises inputting the simulated time-reversal mechanical wave form data to a transducer controlling means, which produces the emitter instructions, and instructs the one or more first transducers.

According to another embodiment, the present invention concerns a method for cleaning a device comprising fluid, the method comprising:

determining one or more target points within the device, positioning one or more first transducers on, or in proximity of, the outer surface of the device, simulating a time-reversal mechanical waveform from the one or more target points towards the one or more first transducers, so that simulated time-reversal mechanical waveform data is produced, inputting the produced simulated time-reversal mechanical wave form data to a transducer controlling means, the transducer controlling means instructing, based on the simulated time-reversal mechanical wave form data, the one or more first transducers, and the one or more first transducers emitting succession of mechanical waves towards the one or more target points based on the instructing.

According to a preferable embodiment the method further comprises positioning one or more second transducers on, or in proximity of, the outer surface of the device. According to this embodiment the one or more second transducers receive mechanical waves, such as acoustic or ultrasound echo waves emitted from the one or more target points, and produce mechanical waveform data. This embodiment comprises also comparing the mechanical wave form data to the simulated time-reversal mechanical wave form data, and modifying, based on the comparing, the emitter instructions and thus also the instructing. According to a particular embodiment, the mechanical waveform data received to the one or more second transducers are transferred to a transducer controlling means, which compares the mechanical waveform data to the simulated time-reversal mechanical waveform data, and modifies, based on the comparing, the emitter instructions and thus the instructing.

According to a particular embodiment the modifying is selected from one or more of: changing waveform shape, changing focus point, changing waveform duration, changing waveform strength.

According to another embodiment the method comprises moving the one of more first transducers and/or the one or more second transducers on, or in proximity of, the outer surface of the device. The moving may be done by using a positioning system 207 shown in FIG. 2*c*. The advantage of the moving is that it allows optimal positioning of the transducers when the cleaning proceeds. Typically, this also includes moving the one or more target points.

According to a particular embodiment, the method comprises positioning of the one or more first transducers. The positioning comprises:

simulating time-reversal waveform from the one or more target points towards outer surface of the device, determining one or more positions on the outer surface of the device at which time-reversal waveform produces strongest focus, and positioning the one or more first transducers on the one or more positions.

The positioning may be done by using a positioning system shown in FIG. 2*c*. The advantage of this embodiment is that the one or more transducers can be kept at optimal position during the whole cleaning process.

The present invention allows controlled cavitation at predetermined positions within a device comprising fluid, such as liquid. According to the present invention the cavitation is created by using mechanical waves such as ultrasound signals generated by the one of more first transducers, preferably at least two first transducers, wherein the emitted mechanical waves are based on output of time-reversal analysis of the device structure. According to a preferable embodiment, the system of the present invention comprises one or more second transducers adapted to receive mechanical waves, such as acoustic or ultrasound wave echoes emitted from the one or more target points, and to transfer the received wave information to the transducer controlling means. The use of the second transducers allows the transducer controlling means to modify e.g. waveform shape, focal point, waveform duration, and wave form strength based on the information received from the one or more second transducers. Accordingly, the data obtainable by the second transduces is used to produce feedback that is, in turn, used to optimize the cleaning.

The present invention allows tuning of coded waveforms for providing the desired cleaning process. When a device comprising fluid, such as liquid, is exposed to mechanical waves, such as ultrasound waves as disclosed herein, the waves create fluid pressure pulsations that in turn gives rise to cavitation. Exemplary cleaning processes obtainable by using the system and the method of the present invention are shown FIGS. 3-17.

Figure 3:
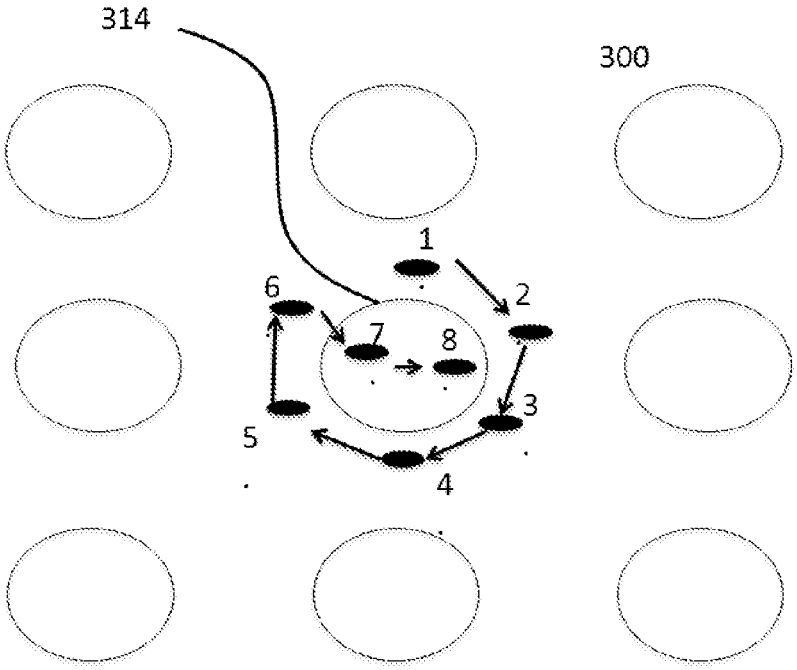
FIG. 3 shows an exemplary non-limiting embodiment for point-by-point cleaning of a specific internal structure of a device by using a system and method of the present invention.

FIG. 3 shows an exemplary point-by-point cleaning of a specific internal structure of a device 300 by using a system and method of the present invention. FIG. 3 shows a front view of the device comprising nine internal structures, one of them marked with reference number 314. The desired internal structure 314 is cleaned by focusing ultrasound to eight predetermined points in the fluid in proximity of the structure 314 to create fluid pressure pulsations. According to an exemplary embodiment, ultrasound is focused to point 1 for 10 min, followed by focusing to point 2 for 10 min etc. According to another embodiment, the focusing is done to point 1 until the scales and/or sludge in the position is removed. The success of removal is determined by the transducer controlling means that compares the echoes from the cleaning position received to the one of more second transducers with the simulation data. The targeted echoes are derived by means of the FEM model (fouling alters the echoes).

Figure 4:
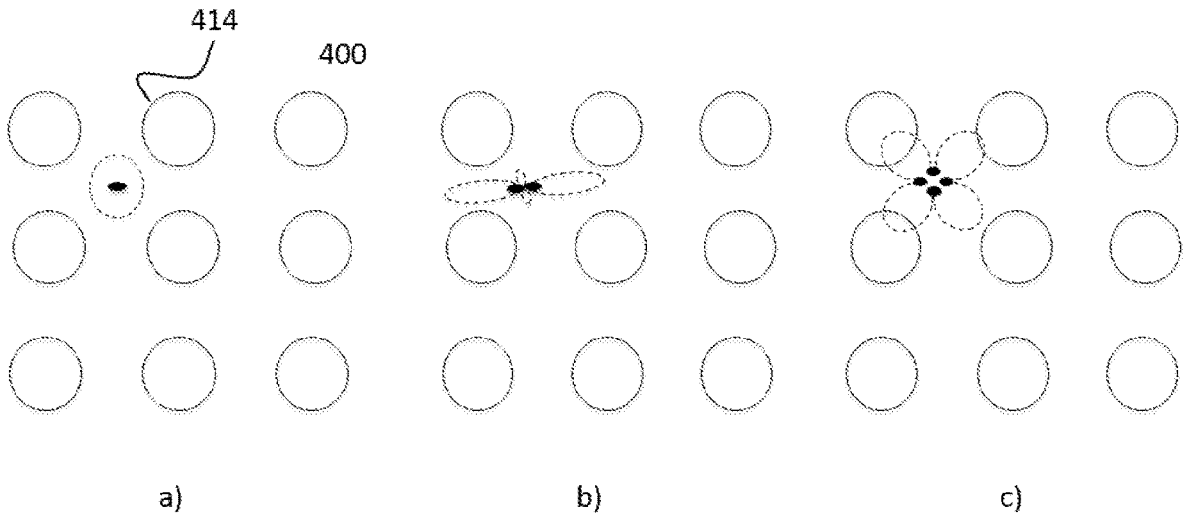
FIG. 4 shows exemplary non-limiting embodiments for enhancing the cleaning effect by using the system and method of the present invention. (a) Traditional monopole excitation (no directivity), (b) dipole excitation featuring directivity, and (c) quadrupole excitation.

FIG. 4 shows further exemplary non-limiting embodiments for enhancing the cleaning effect by using the system and method of the present invention. The circles represent internal structures of the device 400 to be cleaned. An exemplary internal structure is marked with reference number 414. In the embodiment shown therein FIG. 4*a* represents a traditional monopole excitation. According to this embodiment, the wave form has no directivity. The embodiment shown in FIG. 4*b* in turn, shows dipole excitation featuring directivity, and the embodiment shown in FIG. 4*c* exhibits quadrupole excitation. Multipole excitation increases ability to clean hard to corners and reach nooks and crannies. The dotted lines in FIG. 4 represent field lines.

The multipoles shown in FIG. 4 are created by using codes that create point sources at the required points with the required phase relationship with each other. According to the present invention the waveform codes are derived using FEM simulations for the situations one wants to create.

Figure 5:
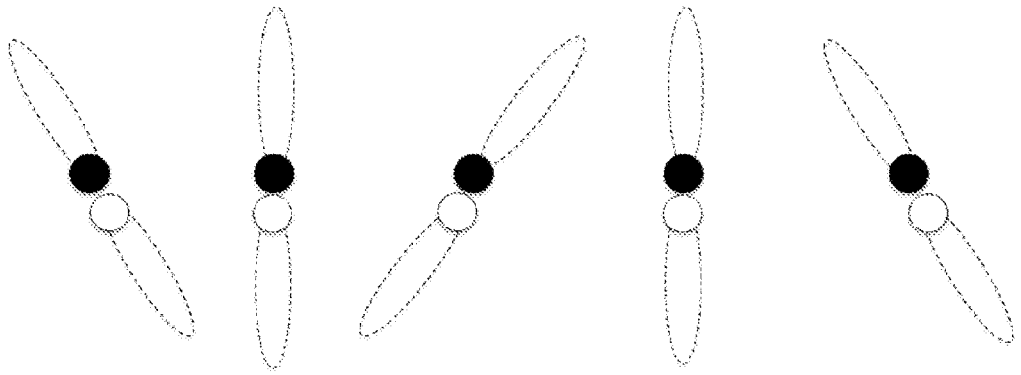
FIG. 5 shows an exemplary non-limiting method according to the present invention, comprising a brushing action to swipe residue away for cleaning enhancement by rotating the dipole rotated back and forth.

One problem in heat exchanger cleaning by using agitation based on the use of mechanical waves such as ultrasonic agitation, is the removal of the sludge and/or scalant from the device. According to the present invention this problem can be solved or at least alleviated by using a waveform that includes a brushing action to swipe the residues away by rotating the dipole rotated back and forth as shown in FIG. 5. The dotted lines shown in FIG. 5 represent field lines. The brushing action is achieved by switching the position of the sources in the dipole. This alters the acoustic axis of the dipole. The wave codes for creating brushing action are created using simulations for the situations one wants to create.

Figure 6:
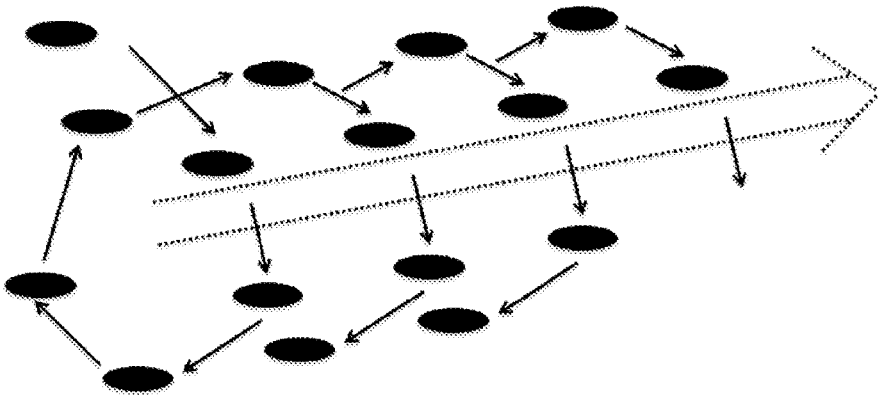
FIG. 6 shows an exemplary non-limiting method according to the present invention, wherein a vortex is created by actuating monopoles in rapid succession.
Figure 7:
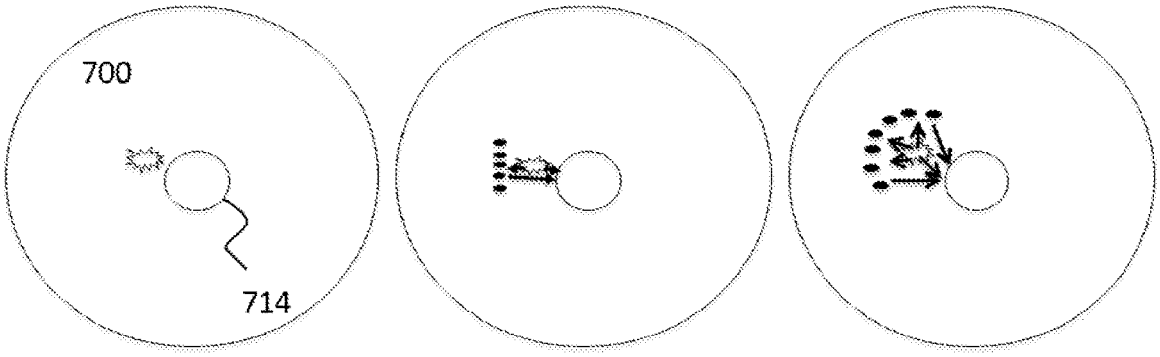
FIG. 7 shows exemplary non-limiting embodiments of the present invention wherein the cleaning process (a) is enhanced by using acoustic mirrors (b) planar mirror; (c) shaped mirror.

According to another particular embodiment, the system and the method is used to create vortex as shown in FIG. 6. The vortex is created by actuating monopoles in rapid succession. The vortex is created by actuating in succession point sources in a circular pattern similar to the concept of acoustic screw driver. The streaming of the vortex can be more efficient in cleaning certain surface topologies, e.g., corners or fields of protrusions 'spike mats' than the brush like action described before. The wave codes for producing the vortex are created using simulations of the present invention.

According to another particular embodiment the cleaning process is enhanced by using acoustic mirrors. The acoustic mirror can be planar or shaped, as shown in FIGS. 7*b* and 7*c*, respectively. FIG. 7*a* shows the situation where no acoustic mirrors are used. The mirrors focus the acoustic pressure towards the predetermined cleaning site. The more effective focusing, in turn allows the use or less powerful acoustic signals if desired while maintaining a certain pressure level at the cleaning site. By inducing curvature in the acoustic mirror, focusing multiplies the cleaning intensity.

The acoustic mirrors are created by creating a line or plane of tiny air bubbles. A focal pattern that resembles the desired mirror shape is determined by introducing a multitude of simultaneously or sequentially launched target points in a simulation. The multitude of focal points in a related reverse drive exhibit the desired mirror shape. The mirror effect is caused by an acoustic discontinuity between the focal pattern which comprises gas due to cavitation bubbles and the surrounding liquid. As a result, the focal pattern works as a nearly perfect mirror to the mechanical wave pulse. The wave codes for producing the desired acoustic mirrors are created by using simulations of the present invention.

Figure 8:
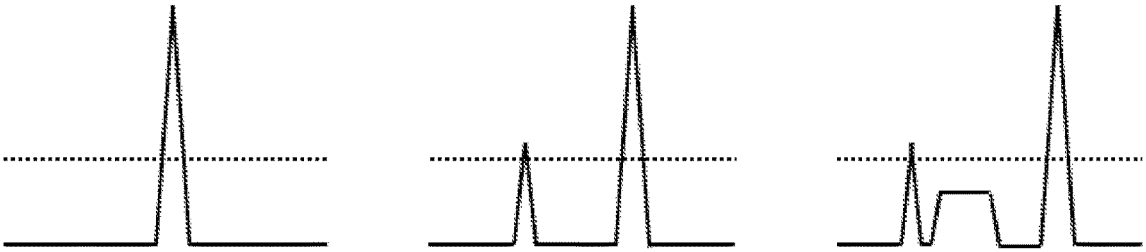
FIG. 8 shows exemplary non-limiting timing diagrams of the present invention left: one main cavitation implosion; middle: pre-ignition+main cavitation implosion; right: pre-ignition+acoustic translation+main cavitation implosion.

FIG. 8 shows exemplary non-limiting timing diagrams of the peak negative pressure amplitude at the focal point. The dashed line indicates the cavitation threshold, i.e. a peak negative pressure amplitude that exceeds this threshold results in cavitation implosion at the pre-determined focal point. The diagram in the left shows a single excitation suitable for several purposes. The diagram in the middle represents double excitation comprising a pre-ignition followed by the main excitation, and the diagram in the right represents triple excitation comprising a pre-ignition followed by sonic translation and the main excitation, respectively. The double excitation permits deterministic positioning of the cavitation whereas the triple excitation permits precise positioning of the cavitation for optimal cleaning.

Figure 9:
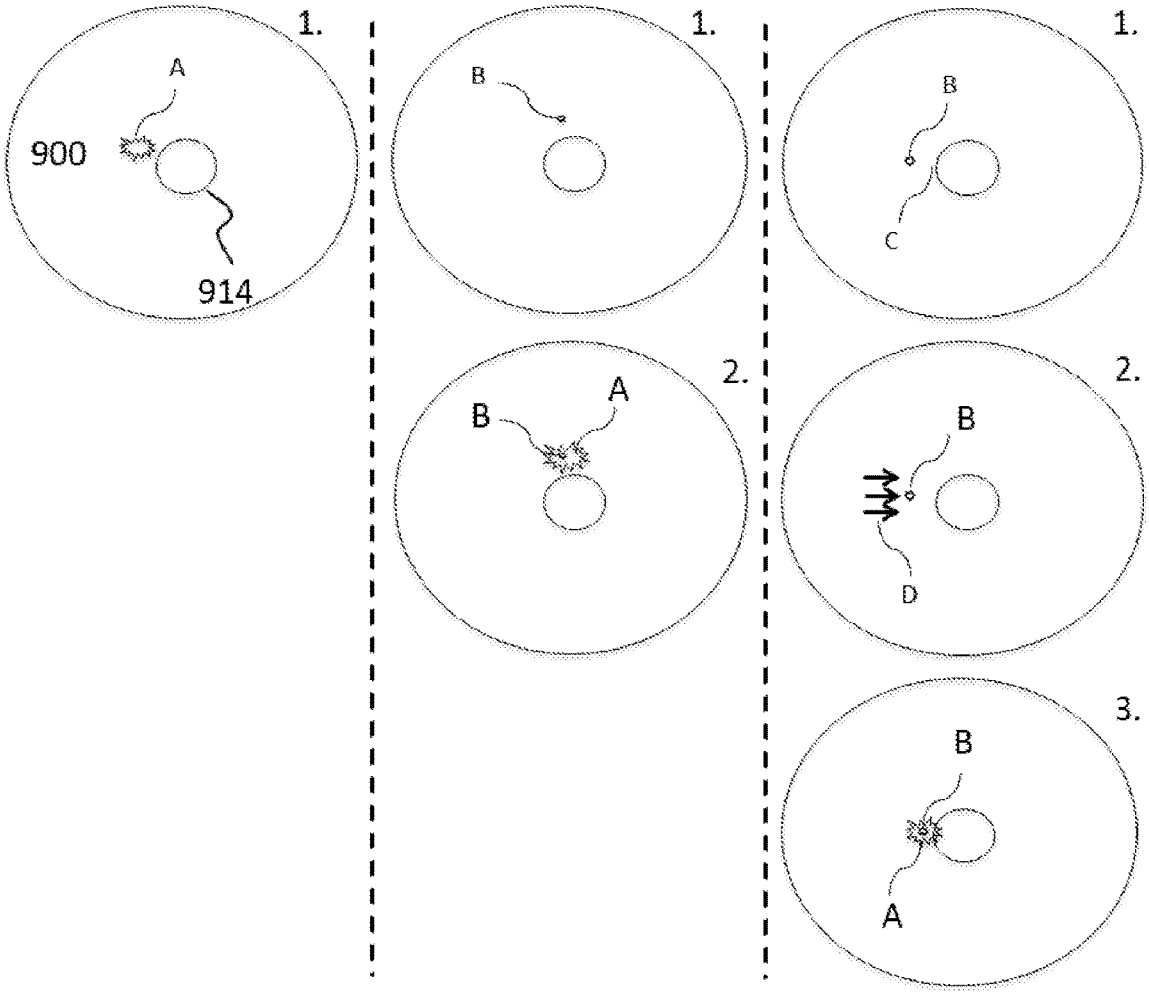
FIG. 9 shows exemplary non-limiting timing diagrams of the present invention left: one main cavitation implosion; middle: pre-ignition+main cavitation implosion; right: pre-ignition+acoustic translation+main cavitation implosion.

The effect of timing diagrams discussed above is shown in FIG. 9. The figure shows a front view of a device 900 comprising an internal structure 914 to be cleaned by using the system and method of the present invention. The cleaning is optimized by controlling cavitation as a function of time and space. FIG. 9 (left) indicates main cavitation implosion at a position (A) which results from a single excitation. The sequence in FIG. 9 middle shows a pre-ignition point (B) being created (residue from cavitation). The main cavitation implosion (A) takes place at the pre-ignition point. The sequence in FIG. 9 right shows the pre-ignition point (B) being created and translated by an acoustic radiation force impulse (D) to an optimal distance from the surface to be cleaned. The main cavitation implosion (A) takes place at an optimal distance (C) from the surface to be cleaned for maximizing cleaning power. The pre-ignition gives rise to small cavitation at a desired position that leaves a disturbed volume that works as a cavitation nucleus for the main cavitation implosion. The codes to create the pre-ignition point and the main cavitation implosion (both position and amplitude) are created by using simulations of the present invention.

In an exemplary non-limiting embodiment of the system, mechanical translation of the transducer assembly, as is shown in FIG. 2*c*, is used for translating the cleaning point along the third dimension of the device.

Outer surfaces of devices, in particular heat exchangers, are often covered, at least partially, with isolating material, such as glass wool. The non-reverberant isolating material is not suitable for transducer attachment, which challenges the device cleaning using mechanical waves.

However, the end portions, in particular the end cups of the heat exchanger are not typically covered by the heat isolating material, and thus these portions are suitable for transducer attachment.

Figure 10:
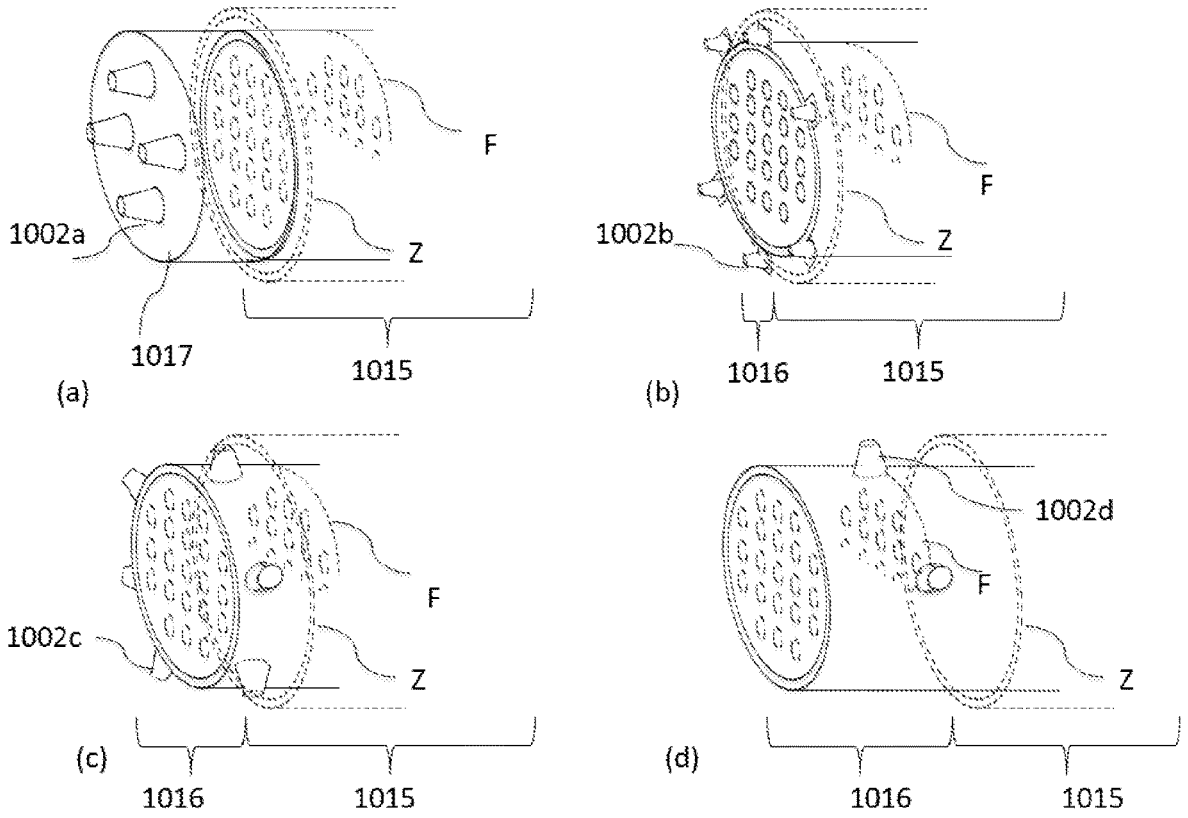
FIG. 10 show exemplary non-limiting ways for transducer attachment to allow mechanical wave focusing using the system and method of the present invention (a) focusing from the end of the device; (b) focusing from protrusions of the device; (c) focusing from the shell of the device (d) focusing from the shell on top of flanges inside the device.

FIG. 10 show exemplary positions allowing transducer attachment. The dotted lines marked with symbol Z represent the edge of the heat insulating material. Accordingly, the device shown therein comprises a first portion, 1015, and a second portion 1016. The first portion comprises material that is not suitable for transducer attachment. For clarity, only representative first transducers and the first and second portions are marked with reference numbers in the figure. The dotted lines marked 'F' represent the internal flanges.

In FIG. 10*a* the first transducers 1002*a* are attached to, or are in contact with, the end portion 1017 of the heat exchanger (end cup), in FIG. 10*b* the first transducers 1002*b* are attached to, or are in contact with, flange portions (protrusion), in FIG. 10*c* the first transducers 1002*c* are attached to, or are in contact with, the side wall, and in FIG. 10*d* the first transducers 1002*d* are attached to, or are in contact with, the side wall on top of an internal flange F. All these transducer arrangements are suitable for use in the system and method for cleaning of the device according to the present invention as discussed below.

Figure 11:
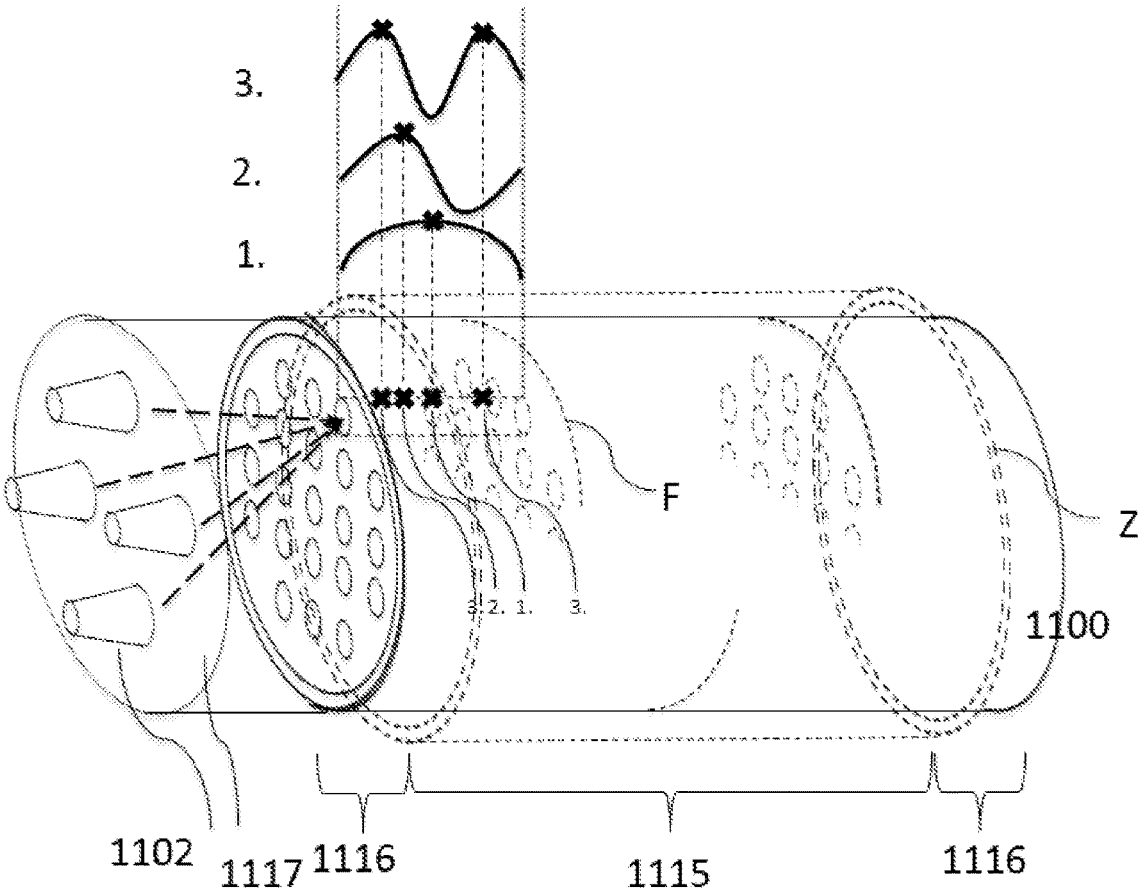

FIG. 11 shows an exemplary non-limiting embodiment for cleaning internal structures of a device 1100 holding fluid, by focusing mechanical waves from first transducers 1102 positioned in the end cup 1117 of the device. Points 'x' in the figure represent 'virtual sources' which excite mechanical code waveforms within the first portion 1116, i.e. wherein transducer attachment is not possible or hard to do. The target points can be placed on the rim of the same cross-sectional disc with the points indicated by 'x'. Any of the points 'x' can also be chosen as a target point. The edge of the heat insulation material is marked 'Z'. According to this embodiment the cleaning is performed by determining virtual sources x, determining target points, positioning the first transducers 1102 on, or in proximity of end portion 1117 of the device, producing simulated standing waveform data, wherein the producing comprises simulating standing time-reversal mechanical waveform that propagates from target points towards x and simulating standing mechanical waveform from points x towards the first transducers, producing emitter instructions comprising the simulated time-reversal standing mechanical waveform data, producing emitter instructions comprising the simulated standing time-reversal mechanical waveform data and instructing, based on the emitter instructions, the two or more first transducers, and the two or more first transducers emitting, based on the instructing, succession of focused mechanical standing waves towards the one or more target points.

According to another embodiment the cleaning is performed by determining virtual sources x determining target points positioning the first transducers 1102 on, or in proximity of end portion 1117 of the device, simulating time-reversal mechanical wave form that propagates from target points towards x and simulating standing mechanical wave from points x towards the first transducers, so that simulated time-reversal mechanical standing wave form data is produced, inputting the produced simulated time-reversal mechanical standing waveform data to a transducer controlling means, the transducer controlling means instructing, based on the simulating, the two or more first transducers, and the first transducers emitting a succession of mechanical standing waves towards the one or more target points based on the instructing.

When the emitter instructions are produced by the transducer controlling means, the step including inputting the emitter instructions to the transducer controlling means can be omitted.

As defined herein, a virtual source (or virtual transducer) is a focal point or a localized pressure maximum inside the device. Its purpose is to transmit mechanical waves (e.g. code wave forms) by mimicking a physical transducer such as a piezoelectric transducer. Virtual sources permit transmission of code wave forms in regions which cannot be directly accessed by real transducers, e.g. due to a coated device shell. Virtual sources are created by placing real transducers into device locations that are accessible. A multitude of virtual transducers transmit code waveforms and create a focal point for cleaning, utilizing the methods disclosed herein. A virtual transducer can also act as a cleaning point as itself.

According to the embodiment shown in FIG. 11, three different standing waves marked 1-3 are used to give rise to actuation at four predetermined target positions in the proximity of the internal structure to be cleaned. Standing waves are generated by choosing suitable frequencies based on structural dimensions from the drawings and the material parameters of the structures and the fluids. The efficiency of the standing wave can be increased by monitoring the power dissipation. This allows to correct for differences between the blue prints and real world situation. By using different standing wave orders the maximum cleaning action is translated along the long axis. Maximum cleaning action occurs where the radial displacement is biggest (antinode of the standing wave).

Figure 12:
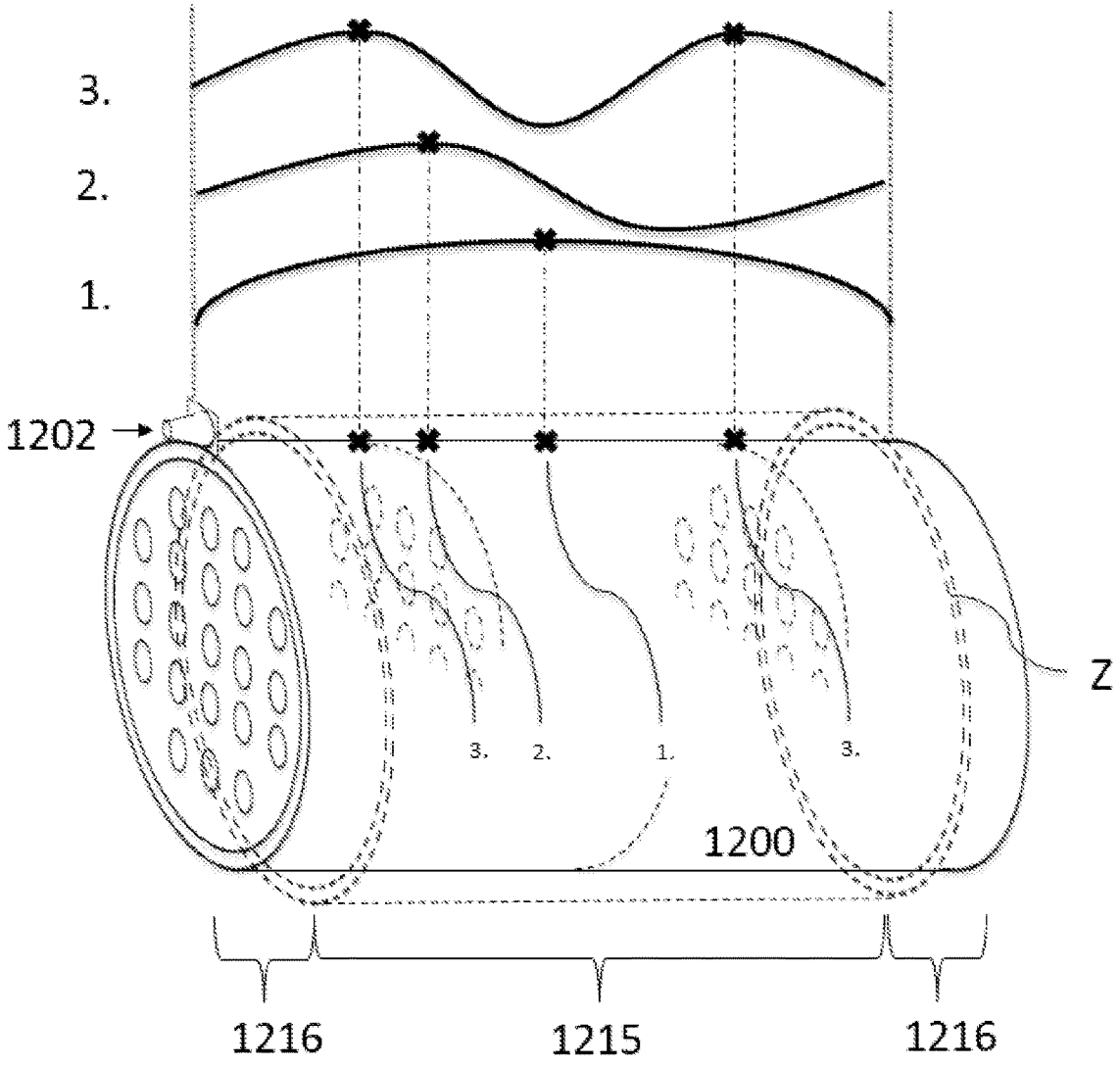

FIG. 12 shows an exemplary non-limiting embodiment for cleaning internal structures of a device 1200 holding fluid, by focusing mechanical waves from first transducers 1202 positioned in contact with flanges of the device. For sake of clarity only a single first transducer is presented. Points 'x' in the figure represent virtual sources which excite mechanical code waveforms within the first portion, i.e. wherein transducer attachment is not possible or hard to do. The target points can be placed on the rim of the same cross-sectional discs with the points indicated by 'x', including that any of the points 'x' also can be chosen as a target point. The edge of the heat insulation material is marked 'Z'. According to this embodiment cleaning is performed by determining virtual sources x, determining target points, positioning the first transducers 1202 on, or in proximity of second portion 1216 of the device, producing simulated time-reversal mechanical standing waveform data, the producing comprising simulating time-reversal mechanical standing waveform that propagates form target points towards x, and simulating standing mechanical waveform from points x towards the first transducers, producing emitter instructions comprising the simulated time-reversal mechanical standing waveform data and instructing, based on the emitter instructions, the two or more first transducers, and the two or more first transducers emitting, based on the instructing, succession of focused standing mechanical waves towards the one or more target points.

According to another embodiment cleaning is performed by determining virtual sources x, determining target points, positioning the first transducers 1202 on, or in proximity of second portion 1216 of the device, simulating time-reversal mechanical wave form that propagates form target points towards x and simulating standing mechanical wave from points x towards the first transducers, so as simulated time-reversal mechanical standing wave form data is produced, inputting the produced simulated time-reversal mechanical standing wave form data to a transducer controlling means, the transducer controlling means instructing, based on the simulating, the two or more first transducers, and the first transducers emitting a succession of focused mechanical standing waves towards the one or more target points based on the instructing.

According to the embodiment shown in FIG. 12, three different standing waves marked 1-3 are used to give rise to actuation in four predetermined target positions in proximity of the internal wall of the outer surface of the device to be cleaned.

Standing waves may be launched e.g. by any of transducer positioning schemes depicted in FIG. 10. Standing waves are generated by choosing suitable frequencies based on structural dimensions from the drawings and the material parameters of the structures and the fluids. By using different standing wave orders the maximum cleaning action is translated along the long axis. Maximum cleaning action occurs at the cross-sectional plane where the radial displacement is biggest, i.e. antinode of the standing wave. An antinode serves as a virtual source for actuation of mechanical waves or as a cleaning point as itself. Such a virtual source can transmit mechanical wave codes, created using simulations. A combination of such virtual sources can create focal points for cleaning.

Figure 13:
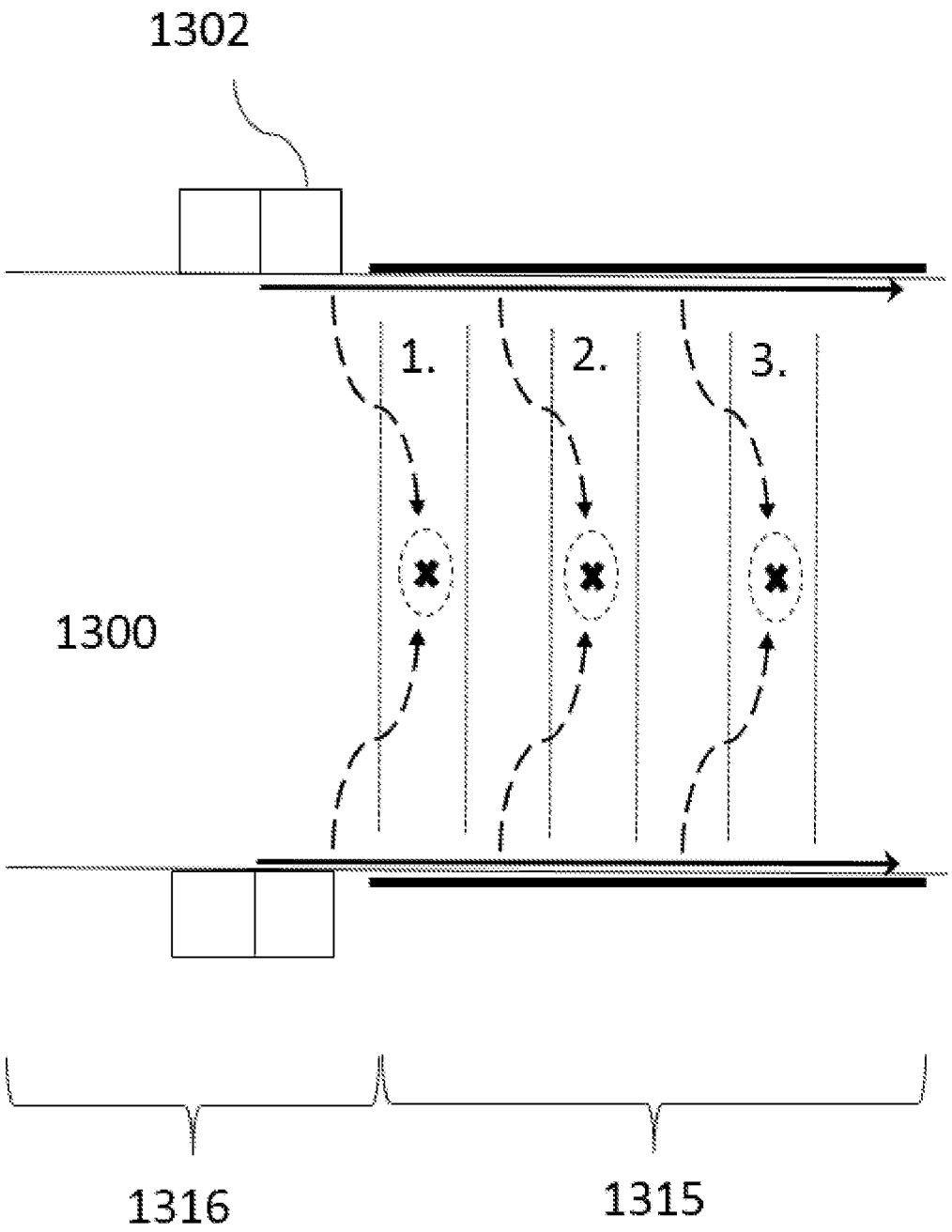

FIG. 13 shows an exemplary non-limiting embodiment of use of leaky waves to propagate actuation point along the shell of a device 1300. The target marked 'x' represents actuation zones. The system shown in the figure comprises first transducers 1302 attached to or being in contact with the second portion of the outer surface 1316 of the device. Leaky waves propagate waves along the inner surface of the shell i.e. from the second portion 1316 to the first portion 1315, along the inner and outer surfaces of the inner structures, and along the surfaces of the flanges that are orthogonal to the pipes.

Leaky waves may be generated by launching, either by single point impact or by multi point phased array like actuating. In FIG. 13, the leaky waves propagate mechanical energy along the inner surface of the shell, along the inner and outer surfaces of the inner tubes, and along the surfaces of the flanges that are orthogonal to the pipes. The solid arrows in the figure represent guided waves on shell and/or pipes of the device. Preferably, a condition of large radial displacement is fulfilled. The radial displacement of the leaky wave in relation to their attenuation as a function of the propagation distance along the structure, this is analyzed analytically or by simulations. The leaky waves add up and create a focus point that can be made to travel along the third dimension of the device (e.g. long axis of a pipe) by controlling the delay and wave form of the leaky waves. This focal point either creates a virtual source for ultrasonic actuation or act as a cleaning point as itself. Such a virtual source can transmit mechanical wave codes, created using simulations of the present invention. A combination of virtual sources can create focal points for cleaning.

Figure 14:
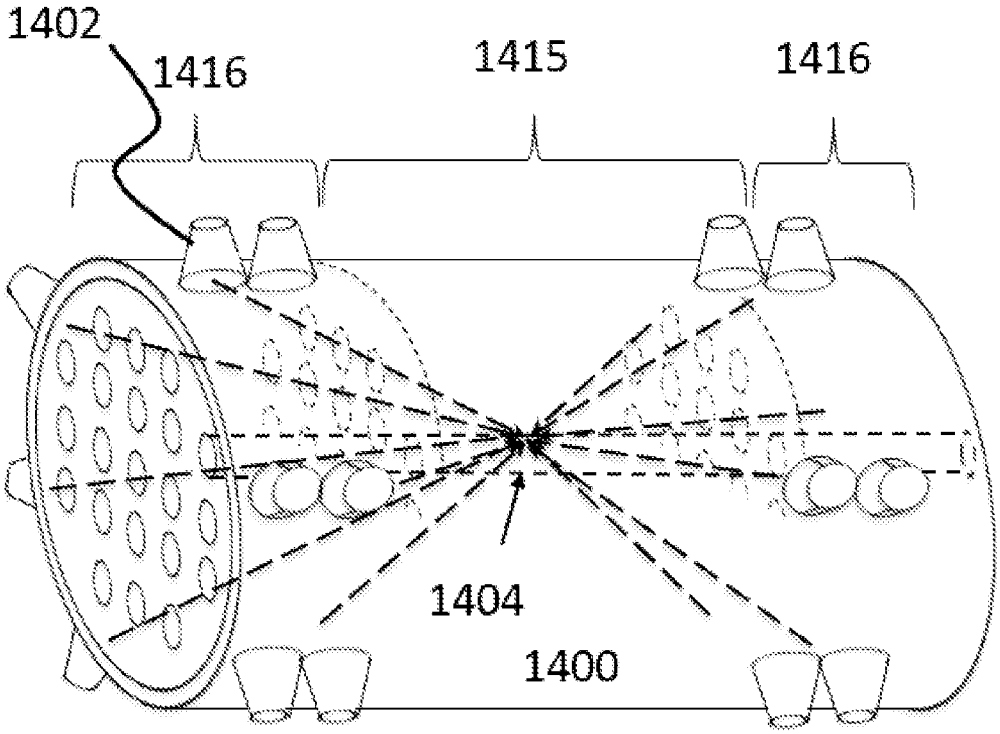

FIG. 14 shows an exemplary non-limiting phase array focusing using the method and system of the present invention. In the figure a plurality of phase array transducers 1402 are used to focus mechanical waves to the target point 1404. Phased arrays are used to tilt the acoustic axis without moving the transducers to form a focal point that serves as a virtual source in for ultrasonic actuation or as a cleaning point as itself. A virtual source can transmit mechanical wave codes, created using simulations. A combination of virtual sources can create focal points for cleaning. The phased arrays can be mounted either on the shell or on the end of the device as shown in FIG. 10 by using phase array transducers. The phased arrays can also be used in a counter-propagating manner.

Figure 15:
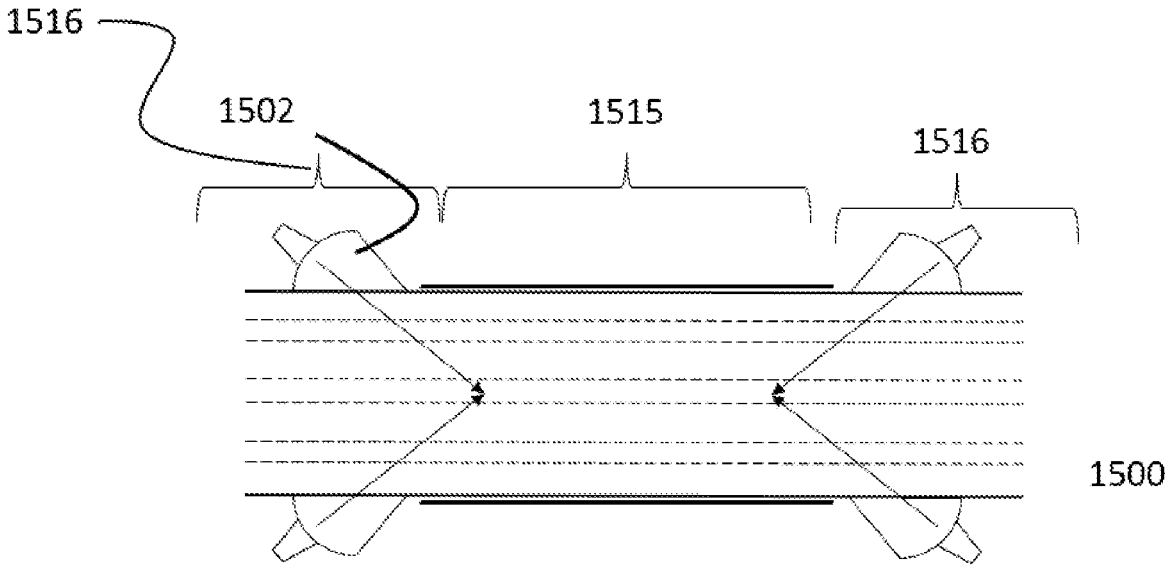

FIG. 15 shows an exemplary non-limiting wedge focusing using the method and system of the present invention for cleaning a device 1500. Wedge transducers 1502 attached to the second portions 1516 of the device. These transducers are used to tilt the acoustic axis without moving the transducers to form a focal point that serves as a virtual source in ultrasonic actuation or as a cleaning point as itself. A virtual source can transmit mechanical wave codes, created using simulations. A combination of virtual sources can create focal points for cleaning. The wedges can be mounted either on the shell or on the end of the device as shown in FIG. 10. The wedges can also be used to launch counter-propagating manner waves.

Figure 16:
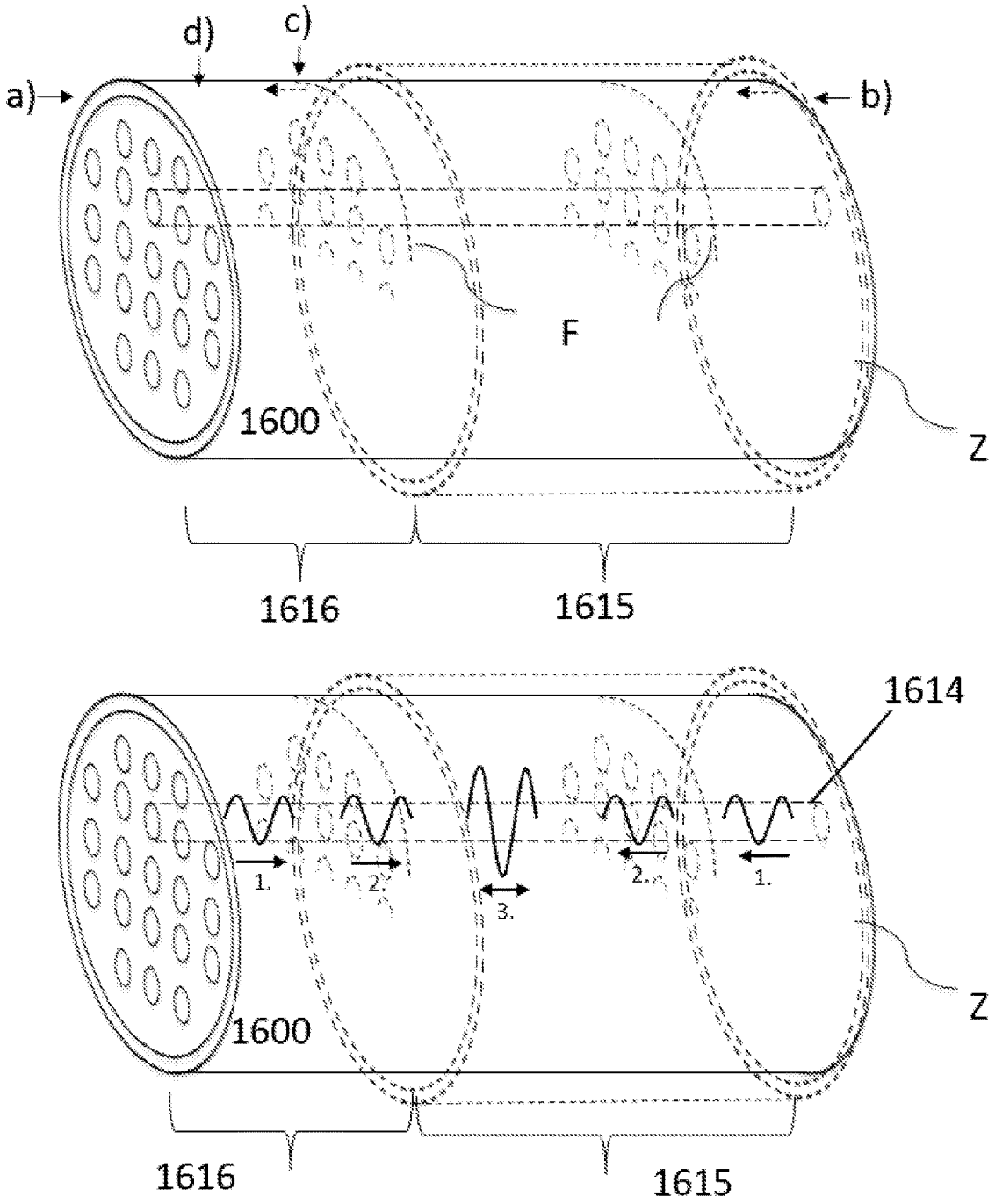

FIG. 16 shows an exemplary non-limiting use of counter-propagating waves utilizing the method and system of the present invention for cleaning of device 1600 within the part 1615 that is unsuitable for transducer attachment. Counter-propagating waves are launched e.g. by any of transducer positioning schemes depicted in FIG. 10. With counter-propagating waves one creates an interference maximum with limited spatial and temporal occurrence (foot print, duration) to serve as a virtual source for mechanical wave actuation. Two waves with properties specified in simulations are launched with controlled delay in time or by proper time-frequency coding specified according to a simulation. FIG. 16 top shows actuation points a, b, c, and d, and the counter-propagating actuation pairs are generated by using case 1: (a,b), or case 2: (a,c), (b,c) and (c,d). The dashed arrows indicate reflections from flanges and end cups. This approach works when only one end of the heat exchanger is reachable. FIG. 16 bottom mid and right shows the long axis view where the virtual so transducer is either on the inner surface of the shell or on the inner or outer surface of one of the inner tubes. A virtual source can transmit mechanical wave codes, created using simulations. A combination of virtual sources can create focal points for cleaning.

Figure 17:
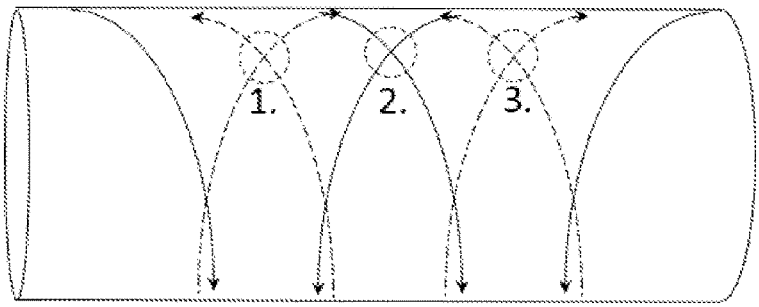

FIG. 17 shows an exemplary non-limiting use of helicoidal waves utilizing the method and system of the present invention for cleaning a device 1700. In any of the four cases described above (standing waves, leaky waves, tilting of the acoustic axis by phased arrays or wedges, and counter-propagating waves) the transducers can be mounted in such a manner and made to launch sound in such a manner that the sound propagates along a helicoidal path along the third dimension of the device (e.g. long axis of a cylindrical device). This could be beneficial as a way to deal with the (internal) flanges prevalent in most heat exchangers.

According to a particular embodiment the feedback and/or a simulation model is used to position the transducers or to deduce preferable positions of the transducers. As discussed above, cleaning can be enhanced by directing the cavitation pressure field using multipoles, vortexes, swiping action, and acoustic mirrors. According to one embodiment cleaning is done point by point in a predetermined manner. However, several points can be cleaned at the same time, if desired. Suitable electronics is applied as known to the art.

According to an exemplary embodiment, the operator chooses from a laptop screen the point(s) to be cleaned and temporal sequence of these points. He also chooses whether feedback is used to optimize the cleaning. The cleaning can be enhanced by directing the cavitation pressure field using multiples, vortexes, swiping action, acoustic mirrors. The operator may choose if the cleaning is done point by point in a predetermined manner. Several points can be cleaned at the same time, if desired. Cavitation can be controlled in time and space using the concept of pre-ignition.

According to a particular embodiment, the cleaning effect is tuned by selecting for either stable cavitation or transient cavitation. To this end, the optimum number of high-power cycles in the focus is determined in silico, in real world situation, or a combination of in silico and real world. The selection is done for maximum cleaning, minimum energy, and minimum strain. According to another embodiment of the system the driving codes are tuned so as to induce, sonoluminescence at the focal point for effective cleaning and removal of bio-like materials or the like. In this case, pressure and plasmatic cleaning such as UVC exposure at close distance can be applied. The combined pressure and non-ionizing radiation is for removing, disrupting, disinfecting, and killing living entities. Optimization of the code waveforms for sonoluminescence emission can in principle be done both in silico, in real world, or in the hybrid or real world and in silico. In practice, there may not be very good models available, however we use/apply the empirical models available in the literature. Moreover, detecting the faint light inside the heat exchanger or even in any kind of industrial vessel may be hard.

The concept of the invention disclosed herein has been proven by test experiments in a model device setup, exhibiting the cross-sectional geometry described in FIG. 1. To this end, a cylindrical acrylic shell (300 mm diameter, 6 mm wall thickness, 300 mm length) is closed from one end by an acrylic plate (10 mm thickness) and sealed by epoxy glue. The so formed vessel features an array of acrylic tubes (25 mm diameter, 2 mm wall thickness) and the vessel is filled with water. Langevin-type piezo transducers (e.g. 6 transducers, 20 kHz center frequency) are mounted along the circumference of the external surface of the model device. The transducers are instructed by simulated code waveforms, created by a microcontroller and amplified by a driving electronics providing, e.g., a 150 watts root-mean-square power per channel.

The code waveforms are determined by finite-element (FEM) simulations using Comsol Multiphysics (version 5.0). Specifically, a transient acoustics module is used. Drawings of the model device geometry are imported into the Comsol model. The materials are modelled as ideal fluids and solids. Coordinates of a preferred target point are chosen and a pressure source is defined at the target point. Pressure waveforms are recorded at the external shell surface, within the segments covered by the Langevin transducers of the corresponding real model. The recorded pressure waveforms are imported into Matlab, their times reversed and magnitudes scaled. The time-reversal code waveforms thus created are then imported into the driving electronics of the real model.

Figure 18:
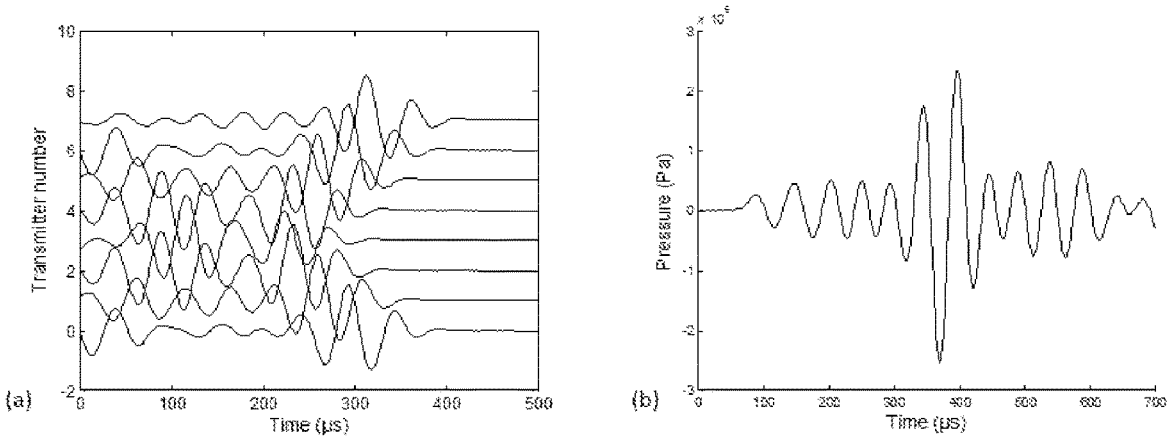
FIG. 18 shows (a) exemplary code waveforms for a short Gaussian-modulated tone burst driving the target point and (b) a pressure waveform recorded at the focal point.
Figure 19:
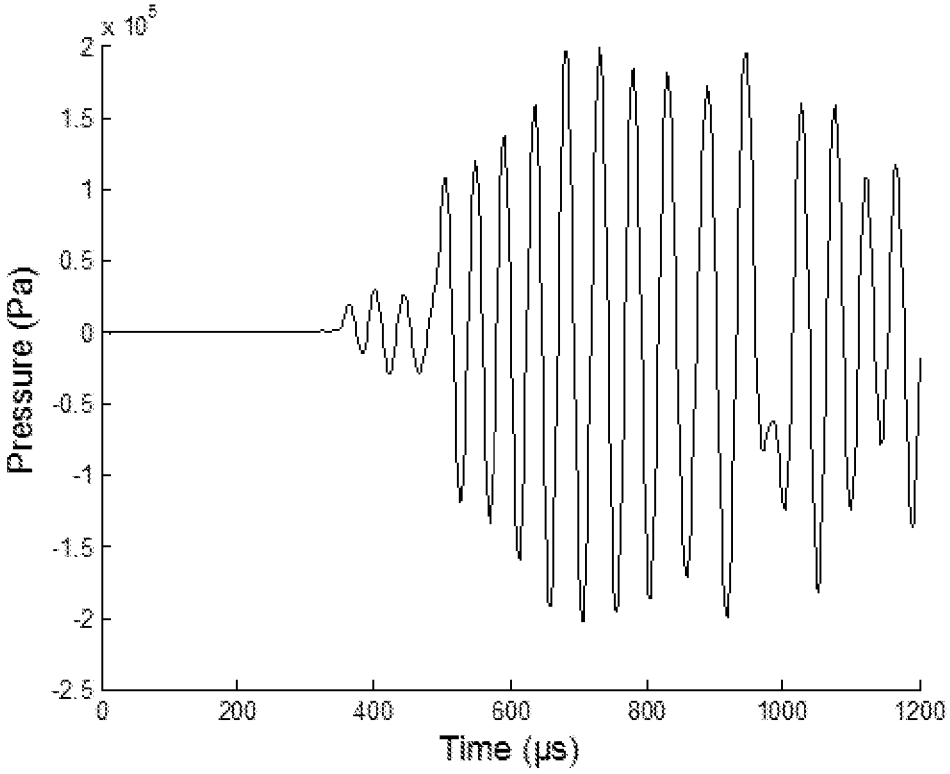
FIG. 19 shows an exemplary pressure waveform recorded at the focal point for code waveforms created by a ten-cycle long chirp-modulated excitation at the target point.

Moreover, the code waveforms are also imported into a reverse time FEM model (Comsol Multiphysics), which differs from the original (forward time) model in that the code waveforms now drive pressure sources at e.g. the six external shell segments where they originally were recorded in the respective forward time simulation. The reverse time simulation indicates, that the code waveforms create a pressure focus at a focal point consistent with the coordinates of the preferred target point defined in the respective forward time simulation. FIG. 18*a* shows code waveforms (recorded by eight transducers at the external shell) resulting from a short Gaussian modulated 20 kHz tone pulse driving the target point, whereas FIG. 18*b* shows a pressure waveform recorded at the focal point. The reverse-time transmitters were driven at 140 kPa pressure amplitude, which is realistic for real Langevin-type piezo transducers, and this resulted in a 250 kPa negative peak pressure amplitude at the focus, which is well above the cavitation limit of water at 20 kHz frequency. To create stable cavitation, long waveforms are needed. FIG. 19 shows a pressure waveform at focus created by use of code waveforms generated by chirp (time-frequency)-modulated excitation at the target point. For example, a chirp-modulated code waveform has been shown to result in a movable cavitation focus, and movable cleaning action, in the real model setup. A hydrophone has recorded negative peak pressure amplitudes exceeding 100 kPa at the focal point.

FEM simulations described above have also been used with altered device geometries and different materials. In particular, the simulations suggest that it is also possible to use the invention disclosed to focus inside device geometries made of e.g. metals (e.g. steel), which is typical for heat exchangers. Furthermore, the method and system of the present invention is suitable for cleaning fluids and suspension e.g. by focusing the mechanical waves towards dirt particles within the fluid towards dirt particles within the fluid.

The use of time reversal techniques requires often a large number of transducers to be able to accurately position the focal spot of the system to a pre-determined location. To achieve high power at the focal spot, power ultrasonic transducers may have to be used, which present challenges due to their limited bandwidth. To reduce the number of transducers required, time reversal through a multiple scattering media can be employed, which has been shown to decrease the number of transducers required to obtain time reversal focus (Sarvazyan et al., IEEE Transactions on Ultrasonics, Ferroelectrics, and Frequency Control, vol. 57, no. 4, 2010, pp. 812-817). Furthermore, time reversal cavities, such as those used by Arnal et al. (Applied Physics Letters 101, 2012, pp 064104 1-4) and Robin et al., (Phys. Med. Biol. 62, 2017, pp, 810-824) have been shown to increase the ultrasonic wave amplitude at the focus (up to 20 MPa with 2 kW input electrical power) while allowing the focal spot to be steered in 3D without physically moving the transducers. Luong et al. (Luong et al. Nature, Scientific Reports|6:36096|DOI: 10.1038/srep36096, 2016) showed that an acoustic diffuser can be used as such a time reversal cavity to further reduce the number of so transducers required.

Figure 20:
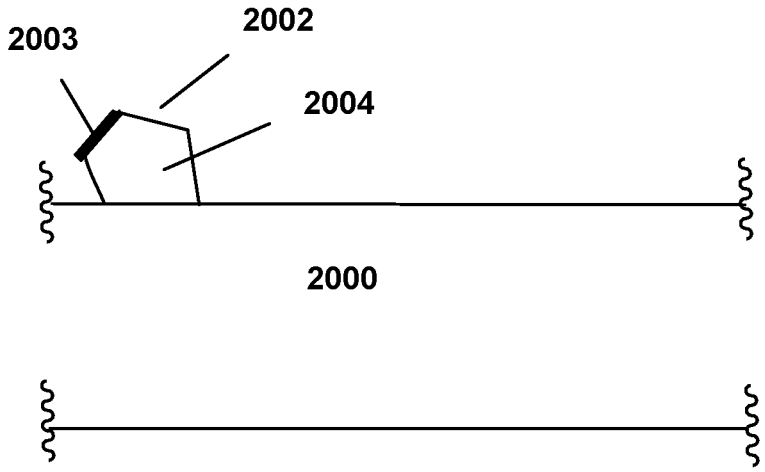
FIG. 20 shows an exemplary non-limiting system according to the present invention wherein one of the first transducers comprises a chaotic cavity.

An exemplary chaotic cavity transducer that is suitable for the system of the present invention is shown in FIG. 20. The transducer 2002 comprises a combination of piezoelectric (PZT) ceramic 2003 attached to a cavity of chaotic shape 2004. An applied source signal to the PZT ceramic generates a wave propagating in the cavity. Each time the propagating wave in the cavity arrives at the boundary between the cavity and the device 2000, part of the incident energy is reflected and continues to engender multiple reflections on the other boundaries of the cavity, whereas the other part of the energy is transmitted in the device. The system may include one or more first transducers comprising a chaotic cavity.

As defined herein an ultrasonic chaotic cavity is a waveguide with a chaotic geometry, e.g. a chaotic billiards, which breaks possible symmetries and generates virtual transducers for time reversal via internal reflections.

According to a particular embodiment one or more of the first transduces of the system of the present invention is a chaotic cavity transducer 2002.

Figure 21:
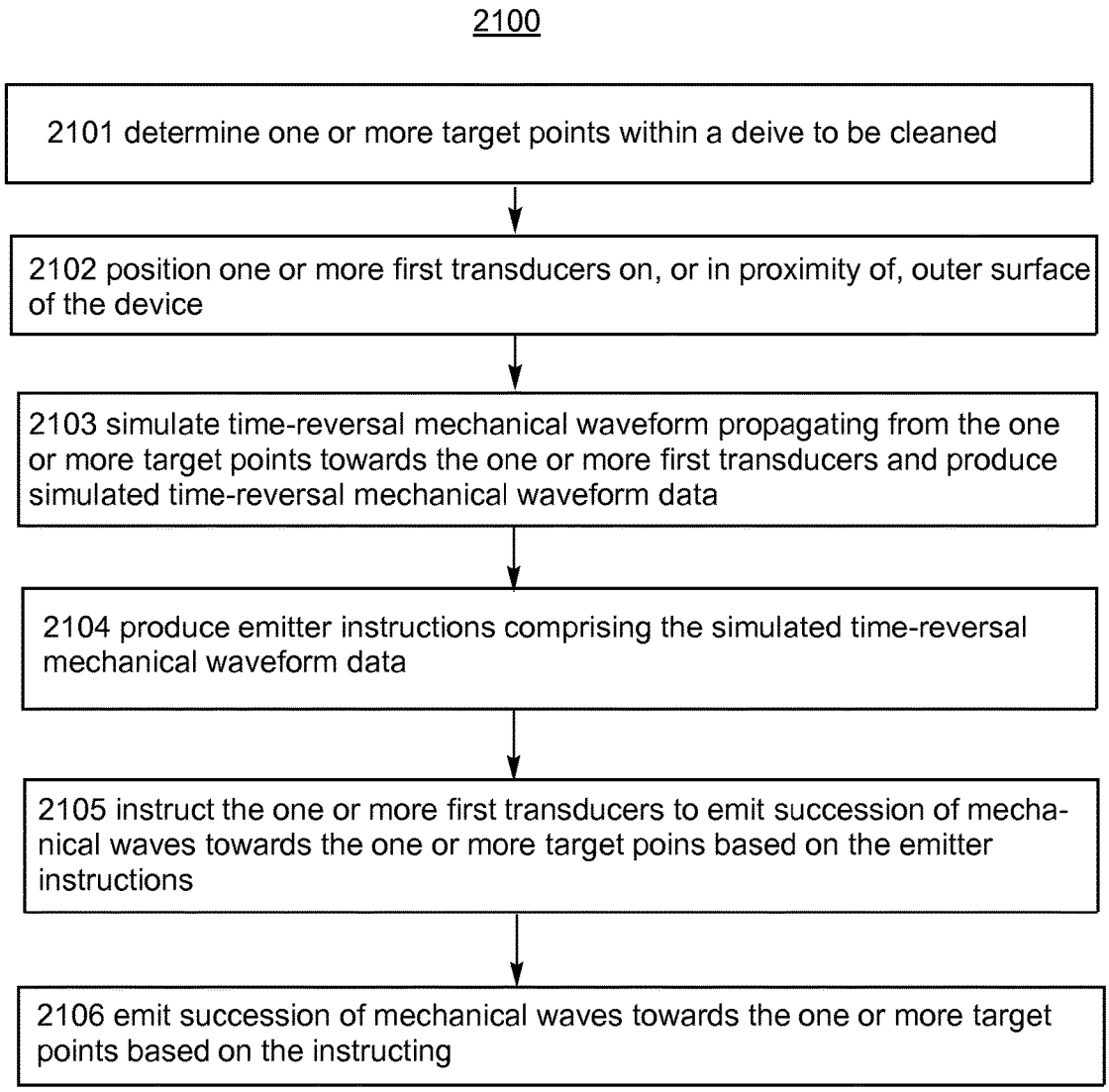
FIGS. 21 and 22 show flow charts of exemplary non-limiting methods of the present invention for cleaning a device for holding fluid.

FIG. 21 shows a flowchart of an exemplary method for cleaning a device for holding a fluid. The method 2100 includes the following actions:

action 2101: determine one or more target points within a device to be cleaned, action 2102: position one or more first transducers on, or in proximity of, outer surface of the device, action 2103: simulate time-reversal mechanical wave form propagating from the one or more target points towards the one or more first transducers and produce simulated time-reversal mechanical wave form data, action 2104: produce emitter instructions comprising the simulated time-reversal mechanical wave form data, action 2105: instruct the one or more first transducers to emit succession of mechanical waves towards the one or target points based on the emitter instructions, and action 2106: emit succession of mechanical waves towards the one or more target points based on the instructing.

Figure 22:
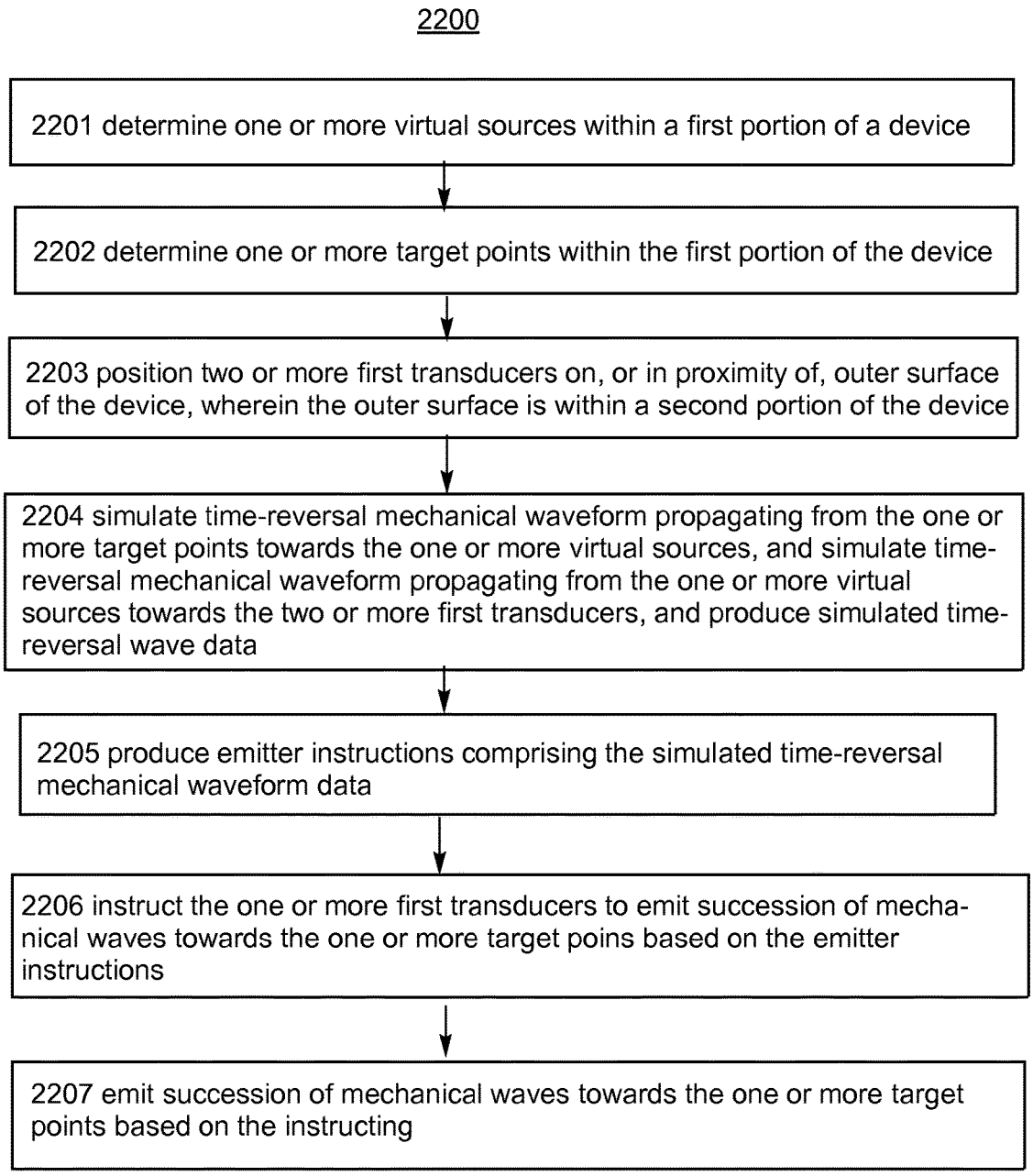

FIG. 22 shows another flowchart of an exemplary method of the present invention. The method of FIG. 22 is particularly suitable when the device is such that positioning of the transduces cannot be optimized. The optimization may be limited e.g. when the part of the outer surface of the device is covered with soft and thick insulation material. The method 2200 comprises the following actions:

action 2201: determine one or more virtual sources within a first portion of a device, action 2202: determine one or more target points within the first portion of the device, action 2203: position two or more first transducers on, or in proximity of, outer surface of the device, wherein the outer surface is within a second portion of the device, action 2204: simulate time-reversal mechanical wave form propagating from the one or more target points towards the one or more virtual sources, and simulate time-reversal mechanical wave form propagating from the one or more virtual sources towards the two or more first transducers, and produce simulated time-reversal mechanical wave form data, action 2205: produce emitter instruction comprising the simulated time-reversal mechanical wave form data, action 2206: instruct the one or more first transducers to emit succession of mechanical waves towards the one or more target points based on the emitter instructions, and action 2207: emit succession of mechanical waves towards the one or more target points based on the instructing.

According to another embodiment, the method for cleaning of a device holding fluid, the device comprising a first portion and a second portion, the method comprises determining one or more virtual sources within the first portion, determining one or more target points within the first portion, positioning two or more first transducers on, or in proximity of, outer surface of the device, wherein the outer surface is within the second portion, simulating time-reversal mechanical wave form propagating from the one or more target points towards the one or more virtual points and simulating time-reversal mechanical wave form propagating from the virtual source towards the two or more first transducers, wherein the mechanical wave form comprises waves selected from one or more of standing waves, counter-propagating waves, leaky waves, helicoidally propagating mechanical waves, so as simulated time-reversal mechanical wave form data is produced, inputting the produced simulated time-reversal mechanical wave form data to a transducer controlling means, the transducer controlling means instructing, based on the simulating, the two or more first transducers, and the two or more first transducers emitting succession of focused mechanical waves towards the one or more target points based on the instructing.

According to a particular embodiment, the method further comprises:

positioning one or more second transducers on, or in proximity of, the outer surface of the device, wherein the outer surface is within the second portion, the one or more second transducers receiving mechanical waves emitted from the one or more target points, and producing mechanical wave data, inputting mechanical wave data to the transducer controlling means, and the transducer controlling means comparing the mechanical wave data to the simulated time-reversal mechanical wave data, and modifying, based on the comparing, the instructing.

The specific examples provided in the description given above should not be construed as limiting the scope and/or the applicability of the appended claims. Lists and groups of examples provided in the description given above are not exhaustive unless otherwise explicitly stated.

What is claimed is:

1. A system for cleaning of a device for holding fluid, the system comprising: one or more first transducers wherein the one or more first transducers are adapted to be positioned on, or in proximity of, outer surface of the device and to emit succession of mechanical waves towards one or more target points within the device, wherein the system comprises: emitter instructions including simulated time-reversal waveform data including data obtained by simulating time reversal mechanical waveform propagating from the one or more target points towards the one or more first transducers, and data about geometry of the device, and a transducer controlling means adapted to execute the emitter instructions to the one or more first transducers for producing the mechanical waves.

2. The system according to claim 1, wherein the data about geometry of the device includes one or more of: technical drawing, computer assisted design, X-ray image, mechanical wave measurement.

3. The system according to claim 1, further comprising:

one or more second transducers adapted to receive mechanical waves from the one or more target points to produce mechanical waveform data, and to transfer the mechanical waveform data to the transducer controlling means.

4. The system according to claim 3, wherein the transducer controlling means is further adapted to compare the simulated time-reversal mechanical waveform data to the mechanical waveform data and to modify the emitter instructions based on the comparison.

5. The system according to claim 3, further comprising a positioning system adapted to move the one or more second transducers, or the one or more first transducers and the one or more second transducers on, or in proximity of, the outer surface of the device.

6. The system according to claim 1, further comprising a positioning system adapted to move the one or more first transducers on, or in proximity of, the outer surface of the device.

7. The system according to claim 1 wherein at least one of the one or more first transducers includes a chaotic cavity adapted to be positioned on, or in proximity of, outer surface of the device.

8. A device for holding fluid including a system for cleaning of the device, the system comprising one or more first transducers positioned on, or in proximity of, outer surface of the device and adapted to emit succession of mechanical waves towards one or more target points within the device, and emitter instructions comprising including simulated time-reversal waveform data including data obtained by simulating time reversal mechanical waveform propagating from the one or more target points towards the one or more first transducers, and data about geometry of the device, and a transducer controlling means adapted to execute the emitter instructions to the one or more first transducers for producing the mechanical waves.

* * * * *